US006191762B1

(12) United States Patent
Kim

(10) Patent No.: US 6,191,762 B1
(45) Date of Patent: Feb. 20, 2001

(54) TIMING CONTROL CIRCUIT OF AC TYPE PLASMA DISPLAY PANEL SYSTEM

(75) Inventor: Se-Yong Kim, Seoul (KR)

(73) Assignee: Daewoo Electronics Co., Ltd., Seoul (KR)

( * ) Notice: Under 35 U.S.C. 154(b), the term of this patent shall be extended for 0 days.

(21) Appl. No.: 09/241,408

(22) Filed: Feb. 2, 1999

(30) Foreign Application Priority Data

Jun. 30, 1998 (KR) ..... 98-25738

(51) Int. Cl.[7] ..... G09G 3/28

(52) U.S. Cl. ..... 345/60; 345/62; 345/63; 345/213

(58) Field of Search ..... 345/60, 63, 67, 345/68, 80, 90, 55, 62, 213

(56) References Cited

U.S. PATENT DOCUMENTS 5,426,446 6/1995 Takei et al. ..... 345/82

FOREIGN PATENT DOCUMENTS 0 837 442 4/1998 (EP) .

OTHER PUBLICATIONS

Database PAJ in EPOQUE: Patent Abstracts of Japan, vol. 98, No. 5, 1998, JP 10–013795 A (FUJITSU) Apr. 30, 1998, 1 page.

*Primary Examiner*—Steven J. Saras
*Assistant Examiner*—Fritz Alphonse
(74) *Attorney, Agent, or Firm*—Pillsbury Winthrop LLP

(57) ABSTRACT

Disclosed is a timing circuit which produces control signals by which a data interfacing section can simultaneously implement input and output operations of a video data from a frame memory and to an address electrode driving section, respectively. A first pulse signal whose pulse duration corresponds to a whole horizontal line time, a second pulse signal which is identical to a delayed first pulse signal by one horizontal line time and a third pulse signal whose pulse duration is the one horizontal line time longer than that of the first pulse signal are produced by using a system clock signal of 2 MHz. During the pulse duration of the third pulse signal, a first clock signal which contains pulse signals whose numbers are one number larger than the numbers of whole horizontal lines (480) by using a system clock signal of 25 MHz. The first clock signal is provided to the data interfacing section to control the input and output operations thereof. A clock signal including 480 numbers of pulses obtained from a logical multiplication of the first clock signal and the first pulse signal is used for a control of an output operation of the frame memory. Another clock signal, which is delayed by the one horizontal line time, including 480 numbers of pulses obtained from a logical multiplication of the first clock signal and the second pulse signal is used for a control of an input operation of the address electrode driving section.

4 Claims, 3 Drawing Sheets

10
AUDIO/VIDEO SIGNAL PROCESSOR
R.G.B
APL
H.V SYNC
12
ADC
14
14a
DATA REARRANGER
14b
FRAME MEMORY
48
14c
DATA INTERFACER
16
TIMING CONTROLLER
20
UPPER ADDRESS ELECTRODE DRIVER
R B G
R B
24
SCAN ELECTRODE DRIVER
26
SUSTEN-TATION ELECTRODE DRIVER
28
22
LOWER ADDRESS ELECTRODE DRIVER
G R B
G
18
HIGH-VOLTAGE GENERATOR
DCV
30
POWER SUPPLIER
ACV

TIMING CONTROL CIRCUIT OF AC TYPE PLASMA DISPLAY PANEL SYSTEM

BACKGROUND OF THE INVENTION

1. Field of the Invention

The present invention relates to a flat panel display apparatus and, more particularly, to a timing control circuit of a plasma display panel (PDP) television which generates clock signals to control input/output operations of a video data to/from a data interfacing circuit.

2. Description of the Prior Art

A PDP system can be classified into an alternating current (AC) type and a direct current (DC) type according to kinds of driving voltages being applied to discharge cells. In FIG. 1, a whole circuit configuration of an AC type PDP color television which relates to the present invention is illustrated. In the AC type PDP color television, a composite video signal received through an antenna is converted into a digital data by an analog-to digital converting section 12 after being processed by an audio/video signal processing section 10. Here, one frame of the composite video signal consists of two fields, that is, an even field and an odd field which are being interlaced, and a horizontal sync signal has a frequency of about 15.73 Khz and a vertical sync signal has a frequency of about 60 Hz. After being processed by a data processing section 14 which contains a data rearranging section 14*a*, a frame memory section 14*b* and a data interfacing section 14*c*, the digital data is transferred to address electrode driving sections 20 and 22 in a form of a data stream which is suitable to a gradation processing characteristic of the PDP television. A high voltage generating section 18 produces control pulses, which are needed for driving an PDP by upper and lower address electrode driving sections 20 and 22, a scan electrode driving section 24 and a sustain electrode driving section 26, and by combining direct high voltages according to logic levels of control pulses from a timing control section 16. A power supplying section 30 takes an AC voltage as an input power source and produces all the DC voltages being necessary for the whole PDP system. Upper address electrode driving section 20 applies address pulses to odd address electrode lines of a plasma panel 28 in responsive to high and low levels of red-green-blue (RGB) data provided by data interfacing section 14*c*, and lower address electrode driving section 22 applies address pulses to even address electrode lines of plasma panel 28 in responsive to the high and low levels of the RGB data provided by data interfacing section 14*c*. Being supplied with a DC high voltage from a high voltage generating section 18, scanning and sustaining sections 24 and 26 provide scanning and sustaining pulses to scanning and sustaining electrode lines of plasma panel 28, respectively. Timing controlling section 16 is supplied with the vertical and horizontal sync signals from audio/video signal processing section 10, produces a data reading clock to be supplied to data rearranging section 14*a*, frame memory section 14*b* and data interfacing section 14*c*, and also produces various logic control pulses to be supplied to high voltage driving section 18.

Generally, for the gradation processing of the PDP, the video data of one field should be rebuilt into multiple subfields and then be rearranged, based on a significance of respective data, in an order from the most significant bit to the least significant bit. Furthermore, prior to being used as a displaying data, the video data in an interlaced scanning way should be converted into a sequential scanning way. Accordingly, frame memory section 14*b* is used as a data storing area for holding the RGB video data of one frame.

Particularly, data interfacing section 14*c* implements cyclic operations of provisionally storing the RGB data of one horizontal line of plasma panel 28 transferred from frame memory 14*b*, rearranging the RGB data to be suitable for an pixel arrangement of plasma panel 28 and providing the rearranged RGB data to upper and lower address electrode driving sections 20 and 22. In order to rearrange the video data of the whole 480 horizontal lines of plasma panel 28 by a data amount of one horizontal line during an addressing time of one subfield, data interfacing section 14*c* has two provisional data storing sections that each of them can store the data amount of one horizontal line (853×3=2559 bits) supplied from frame memory 14*b*. The reason that data interfacing section 14*c* includes the two provisional data storing sections is to secure a continuity of data. Namely, for a smooth display of a moving picture, data interfacing section 14*c* simultaneously implements an input operation to receive the video data from frame memory 14*b* by using a first provisional data storing section and an output operation to transfer stored video data in a second provisional data storing section to address electrode driving sections 20 and 22.

In the simultaneous input/output operations of data interfacing section 14*c*, input/output timings of the video data can be characterized as follows. Data interfacing section 14*c* implements only the input (receiving) operation of the video data because the second provisional data storing section does not have a stored video data during a time interval for loading the video data of a first horizontal line among one subfield to the first provisional data storing section. On the contrary, data interfacing section 14*c* implements only the output operation of the video data because no video data is supplied from frame memory 14*b* during a time interval for outputting the video data of a last horizontal line among the subfield to the address electrode driving sections 20 and 22. Accordingly, during the addressing time of one subfield, one final time that the video data is outputted from data interfacing section 14*c* is behind another final time that the video data is inputted to data interfacing section 14*c* by a delay-time being taken for an input (or output) of the video data of the one horizontal line. The delay-time is about 3 microseconds.

Data interfacing section 14*c* implements the input and output operations of the video signal under a control of control signals produced by timing control section 16. Accordingly, timing control section 16 is requested to produce the control signals suitable for characteristics of input/output operations of the video data of data interfacing section 14*c* as above.

SUMMARY OF THE INVENTION

Therefore, in order to settle the problems of the prior art as described above, it is an object of the present invention to provide a circuit for producing timing control signals to be used for controlling, so that the two provisional data storing sections can simultaneously implement the input and output operations when the data interfacing section which has two provisional data storing sections interfaces the video data from the frame memory to the address electrode driving sections.

In order to achieve the object, there is provided a timing control circuit for a PDP which includes at least a frame memory means, a data interfacing means and an address electrode driving means, comprising:

a first pulse signal generating means for generating a first pulse signal whose level is periodically logic-high with correspondence to a first time interval within which the data interfacing means receives a video data of a whole horizontal line of a plasma panel from the frame memory means;

a second pulse signal generating means for generating a second pulse signal whose level is periodically logic-high with correspondence to a second time interval within which the data interfacing means transfers the video data of the whole horizontal line of the plasma panel to the address electrode driving means;

a third pulse signal generating means for generating a third pulse signal whose level is periodically logic-high with correspondence to a third time interval within which the data interfacing means receives the video data of the whole horizontal line of the plasma panel from the frame memory means and transfers the video data of whole horizontal line of the plasma panel to the address electrode driving means;

a clock signal generating means for generating a first clock signal which includes an N+1 number of pulses, where the numerical value N is the number of the whole horizontal line of the plasma panel, during a time when a level of the third pulse signal is logic-high;

a first logic-ANDing means for producing a second clock signal by logically multiplying the first pulse signal by the first clock signal; and a second logic-ANDing means for producing a third clock signal by logically multiplying the second pulse signal by the first clock signal, wherein the second clock signal, the third clock signal and the first clock signal are provided to the frame memory means, the address electrode driving means and the data interfacing means, the data interfacing means, respectively, and the data interfacing means simultaneously performs an operation of receiving a data of one horizontal line per a period from the frame memory means and an operation of transferring a data received during a previous period from the frame memory.

BRIEF DESCRIPTION OF THE DRAWINGS

The above object and other advantages of the present invention will become more apparent by describing in detail preferred embodiments thereof with reference to the attached drawings, in which.

DESCRIPTION OF THE PREFERRED EMBODIMENTS

Hereinafter, a preferred embodiment of the present invention will be explained in more detail with reference to the accompanying drawings.

Figure 1:
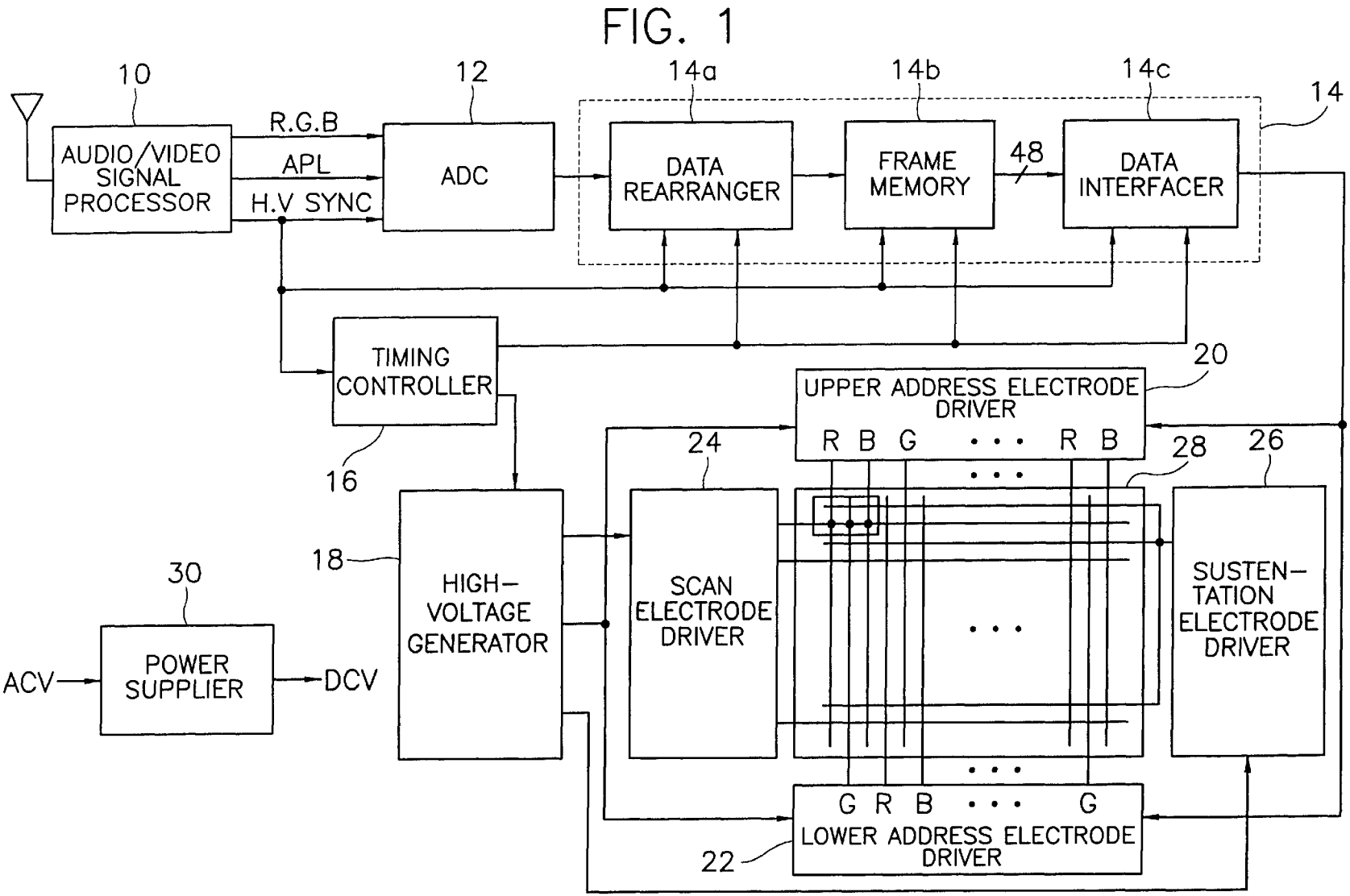
FIG. 1 is a block diagram illustrating a circuit configuration of an AC type of PDP color television set to which the present invention is applied.
Figure 2:
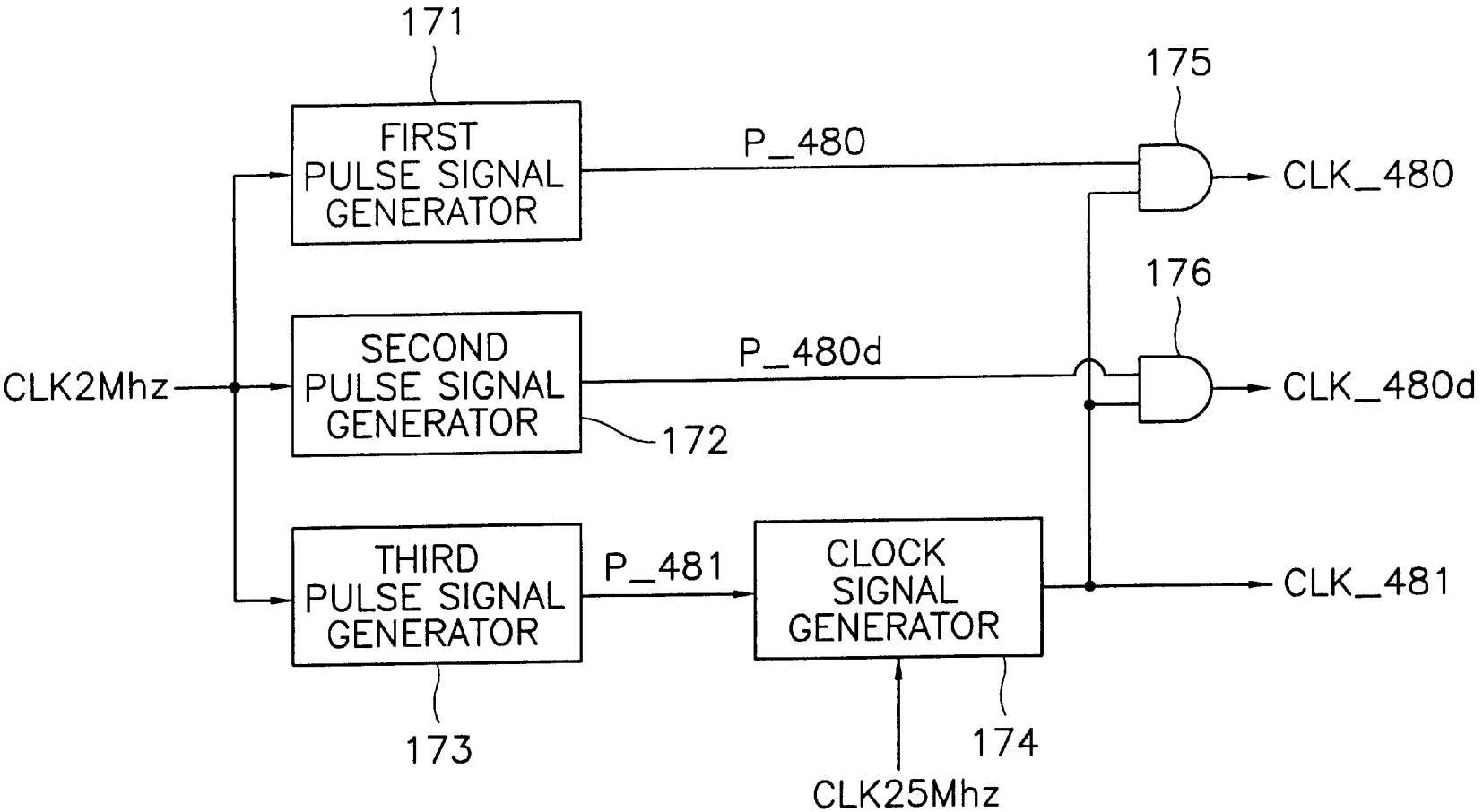
FIG. 2 illustrates a timing control circuit according to an embodiment of the present invention.

In FIG. 2, a circuit configuration of a timing circuit 170 according to the embodiment of the present invention is illustrated. Timing control circuit 170 is a portion of timing control section 16 shown in FIG. 1, and consists of a first periodic pulse generating section 171, a second periodic pulse generating section 172, a third periodic pulse generating section 173, a clock signal generating section 174, a first AND gate 175 and a second AND gate 176.

In an addressing time of respective subfields, first periodic pulse generating section 171 takes a system clock signal CLK2M of a 2 MHz frequency as an input signal to be counted by a binary counter (not shown) therewithin and produces a first periodic pulse signal P_480 whose logic-high level is sustained during a time interval for data interfacing section 14*c* to receive the video data corresponding to the whole 480 numbers of the horizontal lines of plasma panel 28 from frame memory 14*b*, based on the counts of the binary counter.

In the same way, second periodic pulse generating section 172 takes system clock signal CLK2M as an input signal to be counted by a binary counter (not shown) therewithin and produces a second periodic pulse signal P_480*d* whose logic-high level is sustained during a time interval for transferring the video data corresponding to the whole 480 numbers of the horizontal lines of plasma panel 28 from data interfacing section 14*c* to upper and lower address electrode driving sections 20 and 22, based on the counts of the binary counter.

Third periodic pulse generating section 173 also takes system clock signal CLK2M as an input signal to be counted by a binary counter (not shown) therewithin and produces a third periodic pulse signal P_481 whose logic-high level is sustained during a time interval from a first time for data interfacing section 14*c* to initiate a receipt of the video data corresponding to the whole 480 numbers of the horizontal lines of plasma panel 28 from frame memory 14*b* to a second time for data interfacing section 14*c* to complete a transfer of the received video data to upper and lower address electrode driving sections 20 and 22, based on the counts of the binary counter.

Clock signal generating section 174 takes another system clock signal CLK25M of a 25 MHz frequency as an input signal to be counted by a binary counter (not shown) therewithin. During a time when a logic level of third periodic pulse signal P_481 is sustained high, clock signal generating section 174 produces a first clock signal CLK_481 within which 481 numbers of clock pulses being one number larger than the numbers of the whole horizontal lines (480) are included by using the counts of the binary counter.

First AND-gate 175 logically multiplies first periodic pulse signal P_480 generated by first periodic pulse generating section 171 by first clock signal CLK_481 generated by clock signal generating section 174. Accordingly, first AND-gate 175 produces a second clock signal CLK_480 within which 480 numbers of clock pulses being identical to the numbers of the whole horizontal lines while a logic level of first periodic pulse signal P_480 is high.

Second AND-gate 176 logically multiplies second periodic pulse signal P_480*d* generated by second periodic pulse generating section 172 by first clock signal CLK_481 generated by clock signal generating section 174. Accordingly, second AND-gate 176 produces a third clock signal CLK_480*d* within which 480 numbers of clock pulses being identical to the numbers of the whole horizontal lines while a logic level of second periodic pulse signal P_480*d* is high.

Figure 3:
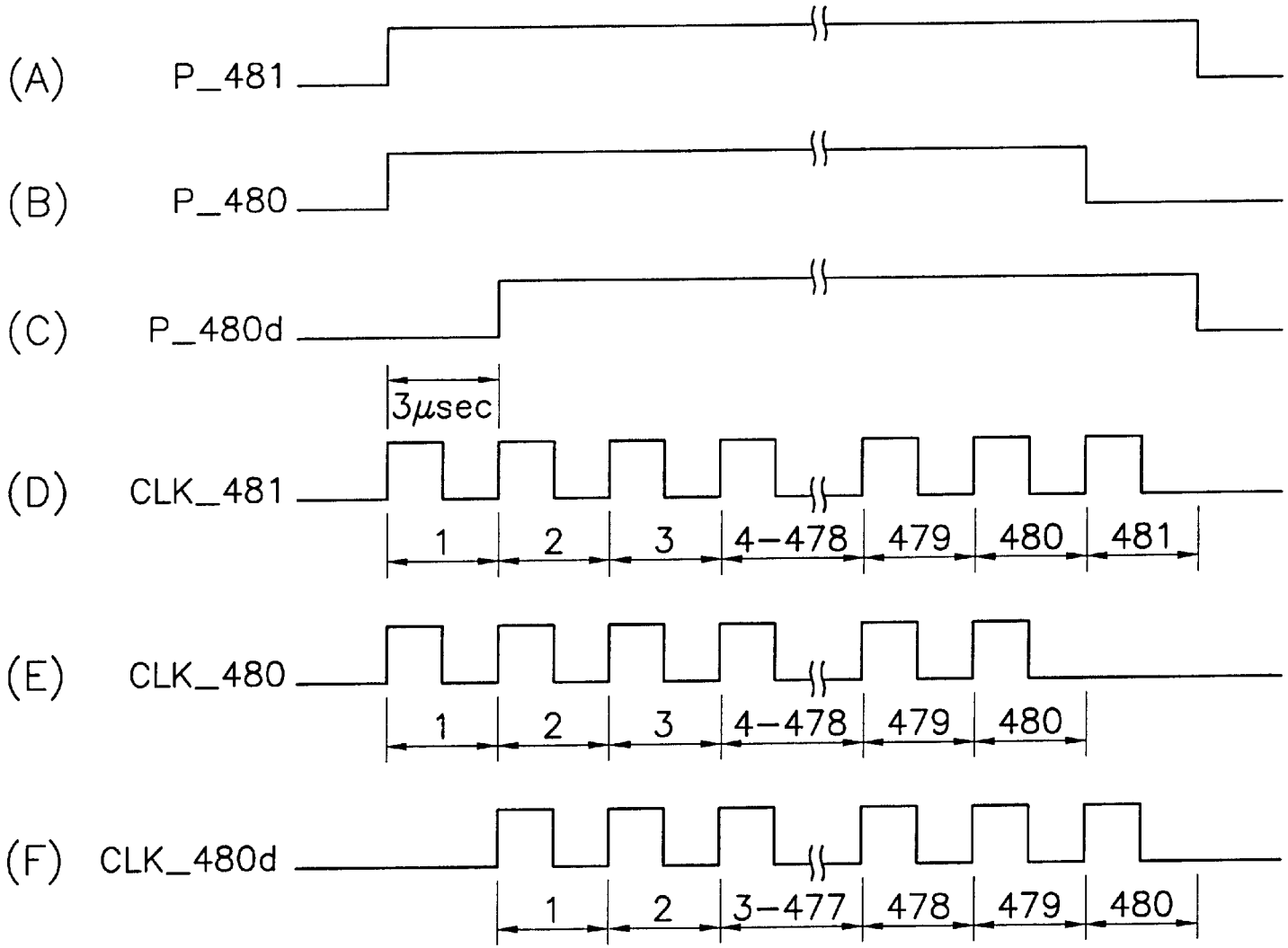
FIG. 3 illustrates a timing chart of control signals relating to the timing control circuit shown in FIG. 2.

Referring to a timing chart shown in FIG. 3 of output signals of timing circuit 170, it can be understood that second periodic pulse signal P_480*d* is identical to a delayed first periodic pulse signal P-480 by 3 micro-seconds. A time interval that a logic level of third periodic pulse signal P_481 is high is about 3 micro-seconds longer than those of first and second periodic pulse signals P_480 and P_480*d*. It is also certain that second and third clock pulses CLK_480 and CLK_480*d* include the 480 numbers of clock pulses within pulse durations of first and second periodic pulse signals P_480 and P_480*d* while first clock signal CLK_481 includes the 481 numbers of clock pulses within pulse duration of third periodic pulse signal P_481. Here, each period of the clock pulses of first to third clock pulses CLK_481, CLK_480 and CLK_480*d* is about 3 micro-seconds.

A time for frame memory 14*b* to initiate an output of the video data to data interfacing section 14*c* is ahead of a time for upper and lower address electrode driving sections 20 and 22 to initiate an input of the video data, which is transferred from frame memory 14*b* during a previous period, from data interfacing section 14*c*. Thus, second clock signal CLK_480 should be provided to frame memory 14*b* and third clock signal CLK_480*d* should be provided to upper and lower address electrode driving sections 20 and 22. Since data interfacing section 14*c* should be kept in an enable state during the input and output operations of one frame of the video data, first clock signal CLK_481 should be provided to data interfacing section 14*c*.

As a result, first and second clock signals CLK_481 and CLK_480 control a transfer of the video data of one horizontal line per period from frame memory 14*b* to data interfacing section 14*c*. In parallel with the transfer of the video data, the video data stored in data interfacing section 14*c* which has been transferred during a previous period is outputted to upper and lower address electrode driving sections 20 and 22.

As described above, the two provisional data storing sections of data interfacing section 14*c* can simultaneously implement the input and output operations according to the control signal provided by timing circuit 170 of the present invention.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A timing control circuit for a plasma display panel which includes at least a frame memory means, a data interfacing means and an address electrode driving means, comprising:

a first pulse signal generating means for generating a first pulse signal whose level is periodically logic-high with correspondence to a first time interval within which the data interfacing means receives a video data of a whole horizontal line of a plasma panel from the frame memory means;

a second pulse signal generating means for generating a second pulse signal whose level is periodically logic-high with correspondence to a second time interval within which the data interfacing means transfers the video data of the whole horizontal line of the plasma panel to the address electrode driving means;

a third pulse signal generating means for generating a third pulse signal whose level is periodically logic-high with correspondence to a third time interval within which the data interfacing means receives the video data of the whole horizontal line of the plasma panel from the frame memory means and transfers the video data of whole horizontal line of the plasma panel to the address electrode driving means;

a clock signal generating means for generating a first clock signal which includes an N+1 number of pulses, where the numerical value N is the number of the whole horizontal line of the plasma panel, during a time when a level of the third pulse signal is logic-high;

a first logic-ANDing means for producing a second clock signal by logically multiplying the first pulse signal by the first clock signal; and a second logic-ANDing means for producing a third clock signal by logically multiplying the second pulse signal by the first clock signal, wherein the second clock signal, the third clock signal and the first clock signal are provided to the frame memory means, the address electrode driving means and the data interfacing means, respectively, and the data interfacing means simultaneously performs an operation of receiving a data of one horizontal line per a period from the frame memory means and an operation of transferring a data received during a previous period from the frame memory.

2. The timing control circuit as claimed in claim 1, wherein rising edge times of the first and third pulse signals are identical to each other, a rising edge time of the second pulse signal is behind the rising edge time of the first pulse signal by a time corresponding to the one horizontal line, falling edge times of the second and third pulse signals are identical to each other, a falling edge time of the first pulse signal is ahead the falling edge time of the second pulse signal by the time corresponding to the one horizontal line.

3. The timing control circuit as claimed in claim 1, wherein each of the first, second and third pulse signal generating means use a first system clock signal of a first frequency as an input signal to generate the first, second and third pulse signals.

4. The timing control circuit as claimed in claim 1, wherein the clock signal generating means uses a second system clock signal of a second frequency which is higher than the first frequency as an input signal to generate the first clock signal.

* * * * *